US006519967B1

(12) United States Patent
Mosemann et al.

(10) Patent No.: US 6,519,967 B1
(45) Date of Patent: Feb. 18, 2003

(54) ARRANGEMENT FOR CASCADE REFRIGERATION SYSTEM

(75) Inventors: Dieter Mosemann, Schildow (DE); Andreas Thiel, Berlin (DE)

(73) Assignee: Grasso GmbH Refrigeration Technology, Berlin (DE)

( * ) Notice: Subject to any disclaimer, the term of this patent is extended or adjusted under 35 U.S.C. 154(b) by 0 days.

(21) Appl. No.: 10/099,325

(22) Filed: Mar. 14, 2002

(30) Foreign Application Priority Data

Aug. 3, 2001 (DE) ..... 101 38 255

(51) Int. Cl.[7] ..... F25B 7/00
(52) U.S. Cl. ..... 62/335; 62/175; 62/197
(58) Field of Search ..... 62/335, 175, 197, 62/509, 513

(56) References Cited

U.S. PATENT DOCUMENTS 3,590,595 A * 7/1971 Briggs ..... 62/197
4,311,498 A * 1/1982 Miller ..... 62/181
4,548,629 A * 10/1985 Chiu ..... 62/335
4,550,574 A * 11/1985 Hohman ..... 62/197
4,660,384 A * 4/1987 Pallanch ..... 62/151
5,161,382 A * 11/1992 Missimer ..... 62/335
5,692,387 A * 12/1997 Alsenz et al. ..... 62/184
6,189,329 B1 * 2/2001 Peterson ..... 62/335

* cited by examiner

*Primary Examiner*—William E. Tapolcai
*Assistant Examiner*—Mohammad M. Ali
(74) *Attorney, Agent, or Firm*—Horst M. Kasper

(57) ABSTRACT

The invention relates to a cascade refrigeration system with screw compressors (3) connected with each other thermally via a heat exchanger (20) wherein the refrigerant of the low-temperature circuit is condensed in said heat exchanger (20), and the refrigerant of the high-temperature circuit is expanded in said heat exchanger (20), and in addition to said heat exchanger (20) a desuperheater (8) is arranged in flow direction ahead of said heat exchanger (20) in which the working medium of the low-temperature side is cooled down, while the working medium of the high temperature circuit is expanded.

3 Claims, 4 Drawing Sheets

ARRANGEMENT FOR CASCADE REFRIGERATION SYSTEM

Figure 1:
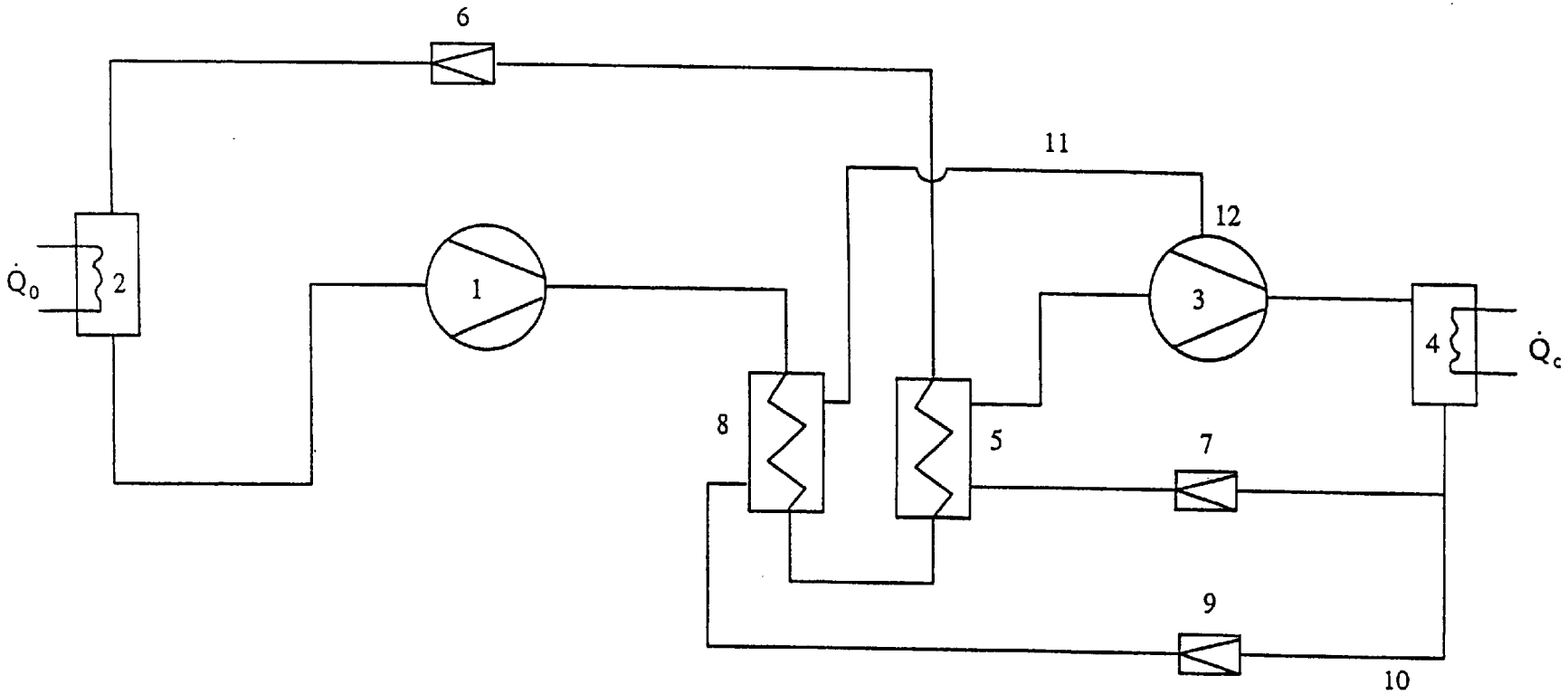

The subject matter of the invention relates to an arrangement in a cascade refrigeration system with screw compressors having a low-temperature circuit and a high-temperature circuit connected with each other thermally via a heat exchanger wherein the refrigerant of the low-temperature circuit is condensed in said heat exchanger, and the refrigerant of the high-temperature circuit is expanded in said heat exchanger. In the evaporator portion of the high-temperature circuit, the energy from the evaporator of the low-temperature circuit and the input power reduced by an oil cooling capacity are removed.

According to prior art, the high-temperature circuit in such systems operates at an evaporating temperature lower than the condensing temperature of the low-temperature system. The refrigerant to be condensed of the low-temperature circuit features a relatively high superheat with resulting relatively great temperature differences occurring in the heat exchanger mentionend above.

A disadvantage of the prior art is that with the system mentioned in the known arrangement a higher energy consumption on the high-temperature side is required for removal of the heat quantity from the low-temperature circuit as refrigeration on the high-temperature side with relation to the outlet temperature of the refrigerant on the low-temperature side is generated at a temperature at which later on condensation of the refrigerant has to take place on the low-temperature side, usually 2 to 5 Kelvin below the condensing temperature of the low-temperature circuit. Thus, generation of refrigeration on the high-temperature side for heat removal from the low-temperature circuit is uneconomical and can be improved.

The object of the invention is to remove part of the superheat from the process of the low-temperature refrigeration system at another evaporating temperature level.

The feature of the invention is that in addition to the heat exchanger mentioned in which the refrigerant of the low-temperature side is condensed, and the refrigerant of the high-temperature side is expanded, a second heat exchanger is arranged in flow direction ahead of the said heat exchanger on the side of the refrigerant to be condensed which is fed by liquid refrigerant from the high-temperature circuit for desuperheating the fluid flow from the low-temperature circuit. This partial refrigerant flow of the high-temperature circuit evaporating as a result will be supplied to the economizer opening on the screw compressor of the high-temperature refrigeration system at which the inlet pressure is higher than the pressure on the suction side of the screw compressor.

The advantage of this technical solution is that the coefficient of performance of the entire system will be improved by 5 to 10%, and hence 5 to 10% of the energy cost will be saved, and the economic efficiency of such system will be improved considerably as a result. The advantage is due to the fact that a portion of the heat is removed from the low-temperature circuit at a higher evaporating temperature at which the Carnot efficiency considerably exceeds the Carnot efficiency at which condensation of the refrigerant takes place in the low-temperature circuit. A further advantage is that due to this arrangement the suction flow rate of the refrigerant compressor on the high-temperature side can be reduced by 10 to 20% with a resulting reduction of the cost of the refrigeration system on the high-temperature side.

FIGS. 1 to 4 show practical examples.

FIG. 1 shows a plant schematic according to the invention consisting of a low-temperature circuit comprising a compressor 1 being of the reciprocating piston-, helical screw- or the like type, an evaporator 2, a control element 6, and a high-temperature circuit comprising a screw compressor 3, a condenser 4, control elements 7, 9 for expansion of the liquid refrigerant, a cascade condenser 5 and a desuperheater 8, wherein both refrigerant flows coming from the low-temperature- and high-temperature circuit pass through the cascade condenser 5 and the desuperheater 8.

The refrigerant coming from the low-temperature circuit is first led through the desuperheater 8. As this takes place, the refrigerant of the low-temperature circuit is nearly cooled down to its condensing temperature by the refrigerant led from the high-temperature circuit via the line 10 and the control element 9 into said desuperheater 8. Thence, the refrigerant is fed from the low-temperature circuit into the cascade condenser 5 where it is condensed by the refrigerant led from the high-temperature circuit via the control element 7 into said cascade condenser 5 with the refrigerant of the high-temperature circuit evaporating and being drawn off again by the screw compressor 3. The refrigerant which has been fed via the line 10 and the control element 9 into the desuperheater 8 is supplied via the line 11 to the economizer connection 12 on the screw compressor 3. Thus, both circuits are closed.

The advantage of this solution is that desuperheating of the refrigerant from the low-temperature circuit takes place in the desuperheater 8 at a higher evaporating temperature than in the cascade condenser 5, whereby the efficiency of this process part is higher than with complete heat removal of the refrigerant from the low-temperature circuit in the cascade condenser 5.

Figure 2:
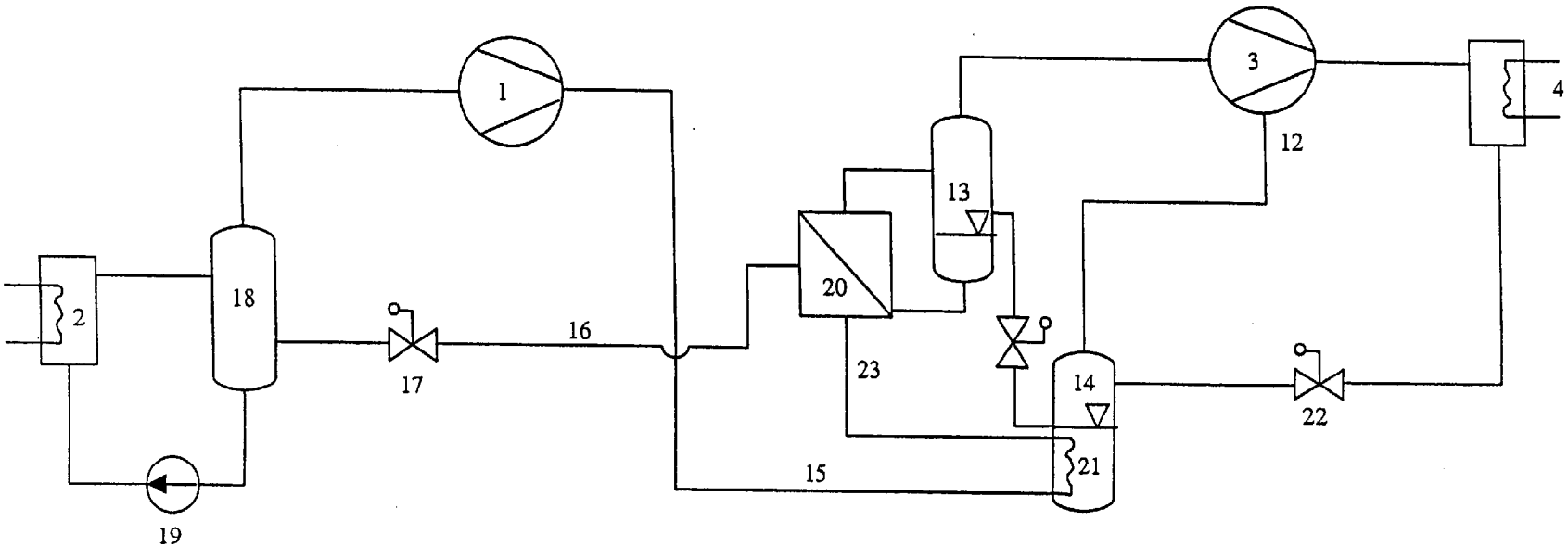

FIG. 2 shows an example of such arrangement according to the invention with flooded heat exchangers comprising a liquid separator 14 and desuperheater 21, separator 13 and heat exchanger 20, where the low-temperature refrigerant is condensed, while the high-temperature refrigerant is expanded, as well as a control element, preferably a high-pressure float 22. In the embodiment shown, the high-temperature refrigerant is expanded in two stages. In the first stage, the refrigerant is fed from the condenser 4 via the control element being a high-pressure float 22 into the liquid separator 14. As this takes place, the flash-gas portion is passed to the economizer opening 12 of the screw compressor 3. The low-temperature refrigerant is led via the line 15 through the liquid section of the liquid separator 14, with the refrigerant being desuperheated in the heat exchanger tube of the desuperheater 21. It passes through the line 23 into the heat exchanger 20 where it condenses. Thence, the liquid refrigerant is led via the line 16 and the control valve 17, preferably a high-pressure float, into the separator 18 of the low-temperature system. There, the refrigerant is delivered through the evaporators 2 by refrigerant pump 19 in known manner in a recirculation system. The heat exchanger 20 operates flooded on the high-temperature side in known manner. Due to thermosyphonic effect, or delivered by a pump, or due to the energy of expansion, the refrigerant passes from the liquid separator 14 into the heat exchanger 20 where it evaporates, with the heat of evaporation removed from the refrigerant of the low-temperature circuit, which condenses as a result.

The advantage of this technical solution is that in addition to the energetic improvement to be obtained by the schematic according to FIG. 1, a further improvement of the process is attained by two-stage expansion of the high-temperature refrigerant whereby the volumetric refrigerating capacity of the high-temperature refrigeration system is increased with an additional improvement of the Carnot efficiency as the said system is operated according to the economizer principle. Compared to prior art, the screw compressor 3 in compliance with the arrangement in the high-temperature circuit according to the invention can be made by about 20% smaller.

Figure 3:
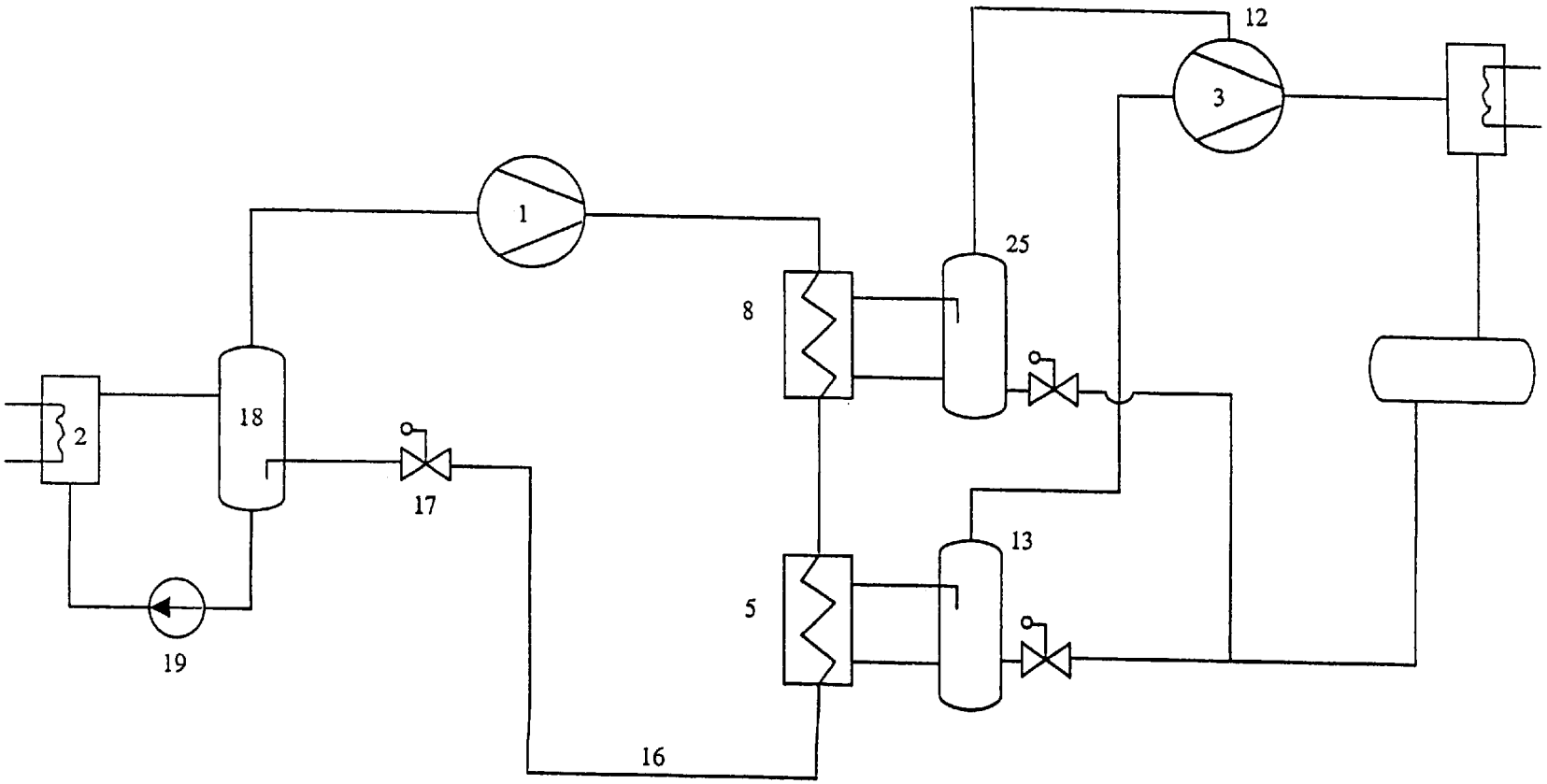

FIG. 3 shows a desuperheater 8 and a cascade condenser 5, both flooded, with an intermediate-pressure separator 25 which is in flow connection with the economizer opening 12. The liquid level in both the separator 13 and the intermediate-pressure separator 25 is controlled by level controllers.

Figure 4:
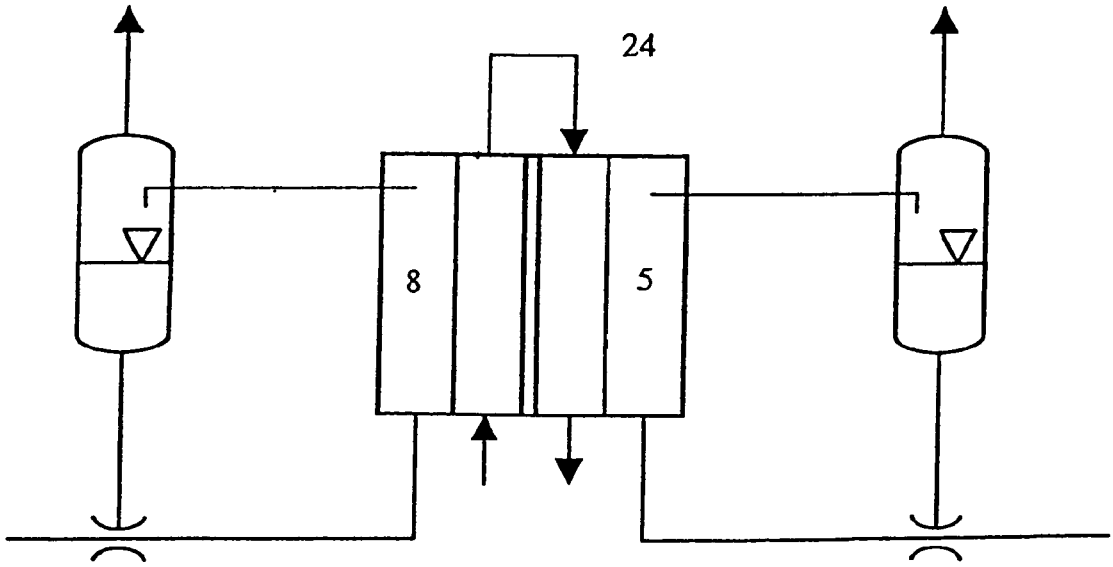

FIG. 4 shows a desuperheater 8 and a cascade condenser 5 arranged in a constructional unit 24.

What we claim is:

1. Arrangement in a cascade refrigeration system with screw compressors having a low-temperature circuit and a high-temperature circuit connected with each other thermally via a heat exchanger wherein the refrigerant of the low-temperature circuit is condensed in said heat exchanger, and the refrigerant of the high-temperature circuit is expanded in said heat exchanger, wherein in addition to a cascade condenser (5) a desuperheater (8) is arranged in flow direction ahead of said cascade condenser on the fluid side of the low-temperature refrigerant with the desuperheater (8) connected via lines with the high-temperature circuit in such a manner that a line via a control element (9) leads to the desuperheater (8), which via a further line (11) is connected to an economizer opening (12) on the high-temperature screw compressor (3).

2. Arrangement in a cascade refrigeration system with screw compressors according to claim 1, wherein the high-temperature circuit is fitted with a liquid separator (14) which is connected to the economizer opening (12) on the screw compressor (3), the desuperheater (21) is arranged in the liquid separator (14), and the line (15) is connected to the desuperheater (21) on the flow side, and the outlet of the desuperheater (21) via line (23) is connected to the heat exchanger (20) on the flow side.

3. Arrangement in a cascade refrigeration system according to claims 1 or 2, wherein a desuperheater (8) and a cascade condenser (5) are arranged in a constructional unit (24).

* * * * *